US009999906B2

(12) United States Patent
Stockard et al.

(10) Patent No.: US 9,999,906 B2
(45) Date of Patent: Jun. 19, 2018

(54) SORTER

(71) Applicant: John Bean Technologies Corporation, Chicago, IL (US)

(72) Inventors: Richard D. Stockard, Kirkland, WA (US); James A. Chalmers, Chelan, WA (US)

(73) Assignee: JOHN BEAN TECHNOLOGIES CORPORATION, Chicago, IL (US)

( * ) Notice: Subject to any disclaimer, the term of this patent is extended or adjusted under 35 U.S.C. 154(b) by 8 days.

(21) Appl. No.: 15/197,565

(22) Filed: Jun. 29, 2016

(65) Prior Publication Data

US 2018/0001353 A1 Jan. 4, 2018

(51) Int. Cl.
*B07C 5/36* (2006.01)
*B07C 5/30* (2006.01)

(52) U.S. Cl.
CPC ..... *B07C 5/368* (2013.01); *B07C 5/30* (2013.01); *B07C 2501/0081* (2013.01)

(58) Field of Classification Search
CPC .. B07C 1/02; B07C 1/06; B07C 5/363; B07C 5/367; B07C 5/368; B07C 2501/0081
USPC ..... 209/44.2, 639, 644
See application file for complete search history.

(56) References Cited

U.S. PATENT DOCUMENTS 3,435,950 A * 4/1969 Suverkrop ..... A01D 33/04 209/557
5,101,101 A * 3/1992 Sawamura ..... B07C 5/3422 209/587
5,590,791 A * 1/1997 Gschweitl ..... B07C 5/02 209/577
6,266,390 B1 7/2001 Sommer, Jr. et al.
6,313,422 B1 * 11/2001 Anibas ..... B07C 5/362 198/370.11
7,007,807 B1 3/2006 Strong
7,014,126 B2 * 3/2006 Boertje ..... B07C 5/368 239/124
7,370,765 B1 * 5/2008 Ellenberger ..... B07C 5/3412 209/587
7,775,369 B2 * 8/2010 Cowling ..... B07C 5/36 209/44.2
7,968,814 B2 * 6/2011 Imai ..... B07C 5/3425 209/576

(Continued)

FOREIGN PATENT DOCUMENTS

DE 36 11 926 A1 10/1987
FR 2 595 589 A1 9/1987

OTHER PUBLICATIONS

International Search Report and Written Opinion dated Sep. 26, 2017, issued in corresponding International Application No. PCT/US2017/039495, filed Jun. 27, 2017, 11 pages.

*Primary Examiner* — Joseph C Rodriguez
(74) *Attorney, Agent, or Firm* — Christensen O'Connor Johnson Kindness PLLC

(57) ABSTRACT

A method and system for sorting workpieces, such as chicken nuggets. The sorting system includes a conveyor system that advances in a forward direction and one or more blow off bars positioned over the conveyor system. The blow off bars extend along the forward advancing direction. The blow off bars include one or more valved nozzles connected to a pressurized source of a fluid, and the nozzles are positioned to discharge the fluid across the conveyor system.

19 Claims, 6 Drawing Sheets

(56) References Cited

U.S. PATENT DOCUMENTS

| | | | | |
|---|---|---|---|---|
| 8,610,019 | B2 * | 12/2013 | Roos | B07C 5/346 209/576 |
| 8,794,447 | B2 * | 8/2014 | Van Kasteren | B07C 5/3422 209/44.2 |
| 9,138,781 | B1 | 9/2015 | Strong et al. | |
| 9,734,569 | B2 * | 8/2017 | Beach | G06T 7/0004 |
| 2004/0163929 | A1 * | 8/2004 | Mills | B07C 5/363 198/438 |
| 2009/0272624 | A1 | 11/2009 | Edwards et al. | |
| 2015/0253746 | A1 * | 9/2015 | Mills | B07C 5/363 209/644 |
| 2015/0266062 | A1 * | 9/2015 | Starzmann | B07C 5/368 209/644 |
| 2016/0016203 | A1 * | 1/2016 | Bamber | B07C 5/34 209/576 |

* cited by examiner

SORTER

BACKGROUND

In industrial processing of meat products, such as chicken, beef, pork and fish, a common problem is to separate pieces of product by weight or dimensions. There are many approaches to separating pieces, including purely mechanical approaches such as roller graders, and electro-mechanical methods such as weigh scale graders, and vision system based systems. Different approaches are useful in solving problems presented by different types and sizes of products. For instance, weigh grading with a weigh belt grader is very common for sandwich sized chicken portions or whole chicken breasts.

However, as the size of the portions decrease while the production rate increases, a problem in sorting occurs when small pieces need to be sorted at a very fast rate. The sorting of raw chicken nuggets is one such problem that still needs to be overcome.

SUMMARY

In some embodiments, the sorting system includes a conveyor system that advances in a forward direction; and one or more blow off bars positioned over the conveyor system, wherein the blow off bars extend along the forward advancing direction, wherein the blow off bars include one or more valved nozzles connected to a pressurized source of a fluid, and the nozzles are positioned to discharge the fluid across the conveyor system.

In some embodiments, the sorting system comprises one or more lane diverter bars positioned over the conveyor system, wherein the lane diverter bars extend along the forward advancing direction and are located before the blow off bars.

In some embodiments, the one or more lane diverter bars and the one or more blow off bars are elongated bars that extend lengthwise along a top surface of the conveyor system.

In some embodiments, the nozzles are positioned to discharge the fluid transversely across the conveyor system.

In some embodiments, the nozzles are aimed upstream or downstream with respect to the forward advancing direction.

In some embodiments, the nozzles are aimed upwards or downwards with respect to a top surface of the conveyor system.

In some embodiments, the sorting system comprises a scanner placed over the conveyor system and before the one or more blow off bars, wherein the scanner is programmed with instructions to determine one or more characteristics of workpieces and assign each workpiece to one or more of a plurality of sorting categories.

In some embodiments, the sorting system comprises a plurality of chutes placed along the conveyor system, wherein each chute has a chute entrance that extends lengthwise along the conveyor system, and the chute entrance is across from a valved nozzle.

In some embodiments, the sorting system comprises a chute diverter including an upright plate, wherein the upright plate is placed on edge across the conveyor system, and the chute diverter is aligned with a lateral edge of the chute entrance.

In some embodiments, the upright plate is placed at an angle to the conveyor system.

In some embodiments, a length of a first upright plate that is across the conveyor system is shorter than a length of an adjacent and subsequent upright plate.

In some embodiments, each of the blow off bars is aligned with one of the lane diverter bars.

In some embodiments, the sorting system comprises at least one blow off bar having a plurality of valved nozzles directed from opposite sides of the blow off bar.

In some embodiments, the blow off bars are straight and have a constant cross-sectional shape for a majority of a length.

In some embodiments, the blow off bars have a section extending down the conveyor system and across the conveyor system.

In some embodiments, at least one blow off bar has a plurality of valved nozzles arranged along a length of the blow off bar.

In some embodiments, at least one blow off bar has a grouping of more than one nozzle, each nozzle aimed across from a single chute.

In some embodiments, a method for sorting workpieces, comprises arranging singulated workpieces on a conveyor system in one of a plurality of lane divisions across a width of a conveyor surface while the conveyor surface advances; determining a characteristic of the workpieces in the lane divisions as the conveyor surface advances and assigning one of a plurality of sort categories to the workpieces in the lane divisions; and blowing off the workpieces from the surface of the conveyor system with a jet of fluid across the surface of the conveyor as the surface advances, wherein the workpieces are blown off corresponding to the assigned sort category for the workpiece, and wherein the workpieces assigned to the same sort category are collected together.

In some embodiments, the workpieces are grouped in a broad sort category when arranged in a lane division, and the workpieces are further assigned to a narrower sort category, and the workpieces that are assigned to a same narrower sort category are collected together.

In some embodiments, workpieces arranged in at least one lane division are arranged inline and are substantially a same distance from a nozzle which blows the workpieces off the conveyor surface.

In some embodiments, the workpieces are raw chicken nuggets.

In some embodiments, the characteristic is selected from the group consisting of weight, color, length, width, height, volume, size, shape, area, contour, fat percent, density, mass, defect, and foreign object, or a combination thereof.

In some embodiments, the method further comprises blowing off the workpieces into one of a plurality of chutes placed along a lateral edge of the conveyor system, wherein each chute is assigned to a different sort category.

In some embodiments, the method comprises blowing the workpieces from a single lane division off the conveyor surface by a single one of a plurality of blow off bars positioned lengthwise along the conveyor surface.

In some embodiments, the method comprises blowing off workpieces from a single blow off bar into one of a plurality of chutes placed on a side of the conveyor system.

In some embodiments, the method comprises blowing off workpieces with a single valved nozzle into a same chute to collect workpieces having a same assigned sort category.

In some embodiments, the method comprises blowing off workpieces with a grouping of nozzles into a same chute to collect workpieces having a same assigned sort category.

In some embodiments, the method comprises blowing off workpieces from a single lane division into only a subset of a plurality of chutes placed along a lateral side of the conveyor surface.

In some embodiments, the method comprises blowing off workpieces from two lane divisions with a single blow off bar having valved nozzles to direct the fluid laterally of the blow off bar.

In some embodiments, the method comprises counting the workpieces that are collected in one or more sort categories.

In some embodiments, the method further comprises resetting the count when the count reaches a predetermined value.

In some embodiments, the method comprises keeping a running weight total of workpieces that are collected in one or more sort categories.

In some embodiments, the method further comprises resetting the running weight total when the weight reaches a predetermined value.

In some embodiments, the method further comprises, for workpieces that do not get blown off after being subjected to a jet of fluid, catching the workpiece in a last one of a subset of chutes arranged to collect all the workpieces from a single lane division.

In some embodiments, the method comprises keeping a running total weight in a sort category and collecting workpieces of different types to meet a predetermined ratio.

The sorting system and method solves problems associated with sorting very small pieces of meat, and in particular, naturally cut chicken nuggets. Chicken nuggets typically range in size from 10 g to 30 g, and so require the handling of potentially several tens of thousands of pieces per hour to be commercially viable.

It is not commercially acceptable to be "short" on weights, so weight variations of nuggets result directly in increased giveaway by the store. The more accurate that sorting of nuggets can be achieved into narrow weight ranges, the less the giveaway. Currently, processors are asking for sorting systems that require repeatable sub-gram accuracy. This accuracy cannot be achieved with purely mechanical systems, such as roller graders (which sort based on a single dimension). Other systems are too slow and cannot process and sort quickly enough.

Weigh graders require pieces to be run on a separate small section of belt supported by a load cell. Individual pieces are weighed as they pass over the load cell. Generally, pieces must be separated by at least the length of these separate small sections of belt so that the scale weighs only one piece at a time. Following weighing, the pieces travel down a long section of belt with paddle arms that extend out to divert the individual pieces of product off the belt into the appropriate weight classification. Again, the pieces must be separated enough to allow the paddle arms to both extend out and retract while only hitting a single piece at a time. Typically, the distance separating any two nuggets being weighed on a weigh grader system would be in the range of 10 to 20 inches, at a minimum. To help increase capacity, weigh belts are generally run at very high belt speeds in the range of 200 to 400 feet per minute. However, even with these belt speeds, many weigh graders of relatively long lengths are required to achieve a typical product rate of thousands of pounds per hour. Belt scales also only generally include two lanes on a conveyor. The accuracy of these systems decreases with increasing belt speeds, and accuracy in the sub-gram range is required.

This disclosure involves using vision systems to determine the volume of nuggets on a belt. With vision systems, the pieces being "weighed" need very minimal separation of about less than an inch to determine the weight of individual pieces. Additionally, this separation can be both in the down belt or cross belt direction, since vision systems may divide a belt into many logical "lanes." The result is a vision device that in the same ten to twenty inch footprint of a pair of weigh scales, could, at the same belt speeds, determine the weights of many times the number of nuggets as compared to a weigh scale.

Weighing or in any way classifying product at a very high rate in a very small footprint is of little use if the pieces cannot be physically separated from each other in the sorting step. This disclosure uses compressed air, for example, to sort product. There is no "paddle" to move product off the belt, only a blast of well-directed and timed air. There are limitations to this approach when applied to nuggets. As discussed previously, to be practical means rates in the thousands of pounds per hour, which require using very high belt speeds to move a large number of nuggets that are spaced as close as possible. Nuggets are on average only about an inch long, so the blow off mechanism must operate very quickly and precisely to hit the targeted nugget and only the targeted nugget as it goes past. Additionally, a sorting system is more useful when it can achieve more sorts per lane. Economics favor a belt sorter with potentially many different sorts.

Blowing larger products off the belt entails utilizing a sufficient amount of air for a long enough time period to move the larger pieces off the belt. The nozzles used for blowing large pieces are specially engineered to move the air in a particular pattern and often include entrained air. The major challenge is moving the large mass of the product. In the case of nuggets, the mass is small, and the time is extremely short. So, a short blast that need not be so finely focused, but precisely timed, is appropriate.

With small nuggets, the nozzle will be most effective when it is targeting the rapidly moving nuggets at a relatively consistent distance from the nozzle—roughly from 1 to 3 inches from the nugget. A very short blast of air lasting in the tens of milliseconds will provide sufficient accuracy.

A short, precisely timed blast of air is more effective overall than a longer "blow" of air. As an example, a one-inch long nugget passing the nozzle at 150 fpm will move entirely past the nozzle in 33 msec. A 15 msec blast of air will likely only hit the nugget going past, however, a 33 msec blast of air will certainly be either too early or too late (as some variation and inaccuracy in timing is inevitable) and miss the nugget for some part of the time. This is particularly true if the distances from the nugget to the nozzle varies. When the blast is too early or too late, the blast may move nuggets that are before or after the target nugget.

Another aspect of accuracy and precision is the aiming of the nozzle. The nozzle must be accurately aimed in both the cross belt direction and the vertical direction. The aiming of nozzles takes time and experience, and so, a system designed to allow very easy and repeatable aiming of the nozzles during numerous disassembly and reassembly during cleanup by unskilled labor is desirable.

The air pressure can also affect the accuracy and effectiveness of the blow off. A very consistent air pressure will provide the most precise blow off. Related to that, in general the larger the volume of air used, the more air that must be replaced and moved through the system, and the less consistent the pressure control. The system both minimizes the amount of air used, but also provides a buffer tank to smooth out the pressure cycles.

The system allows flexibility in the setup of the sorts. The economics of sorting systems favor easy flexibility of use. As an example, adjustable blow off nozzles that could precisely blow off a nugget or a large sandwich portion would be desirable. However, if flexibility requires precision adjustment of the nozzle by a trained mechanic, it may not be a practical approach. An adjustable (flexible) nozzle may also have a cost in lost precision. This system provides flexibility by allowing many sorting configurations. In addition, the system is designed to have interchangeable parts that are precisely manufactured to allow easy interchange by untrained workers for various products and sorting configurations.

Among sorting configurations, the software and hardware can work together to provide easily configurable numbers of lanes, sorts, and width of sort. The width of sorts is of particular value, since in a precision system, the closer the nozzle is to the sort receptacle (bin, box, hopper, or conveyor), the narrower the receptacle can be. Additionally, the narrower the receptacle, the more practical the sorting system, since more sorts can be configured with a shorter belt.

The number and width of the lanes are related. Very large pieces, such as chicken butterflies, may be difficult to blow for a long distance, and their width across the belt limits the possible number of lanes. Conversely, small chicken nuggets are relatively easy to blow longer distances. Chicken nuggets are also very narrow, and so, are suitable for a greater number of lanes and sorts, but narrow lanes and sort bins. In this approach, the same sorting system could be easily and quickly configured for either butterflies with maybe two lanes and four sorts, or nuggets with maybe eight lanes and thirty-two or more sorts, simply by changing out the blow off bars and the lane diverters along with the preconfigured software that includes the precisely required down-belt delays and blow off times.

Another embodiment may include aiming more than one preconfigured nozzle at large products to allow precision timed blow off of large pieces of product using two or more nozzles at a time.

The solution to many of these problems has been found to be specially designed blow off bars that have the required nozzles embedded in the bar. Embedding the nozzles allows them to be both preconfigured to a very exact location and orientation (aim), and also very small so they require little belt space. With this approach, it is possible to simply configure the sorting system in many different ways very quickly and simply without trained labor. As an example, a same belt sorter could be used to blow off a total of three sorts of relatively large products in two lanes, or alternatively, with reconfiguration thirty-two sorts in eight lanes.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A system for the sorting of food portions or other materials is disclosed. While the description may generally refer to food portions, such as chicken nuggets, it is to be appreciated that the disclosed system can be used to sort a variety of other objects, food or otherwise.

Figure 1:
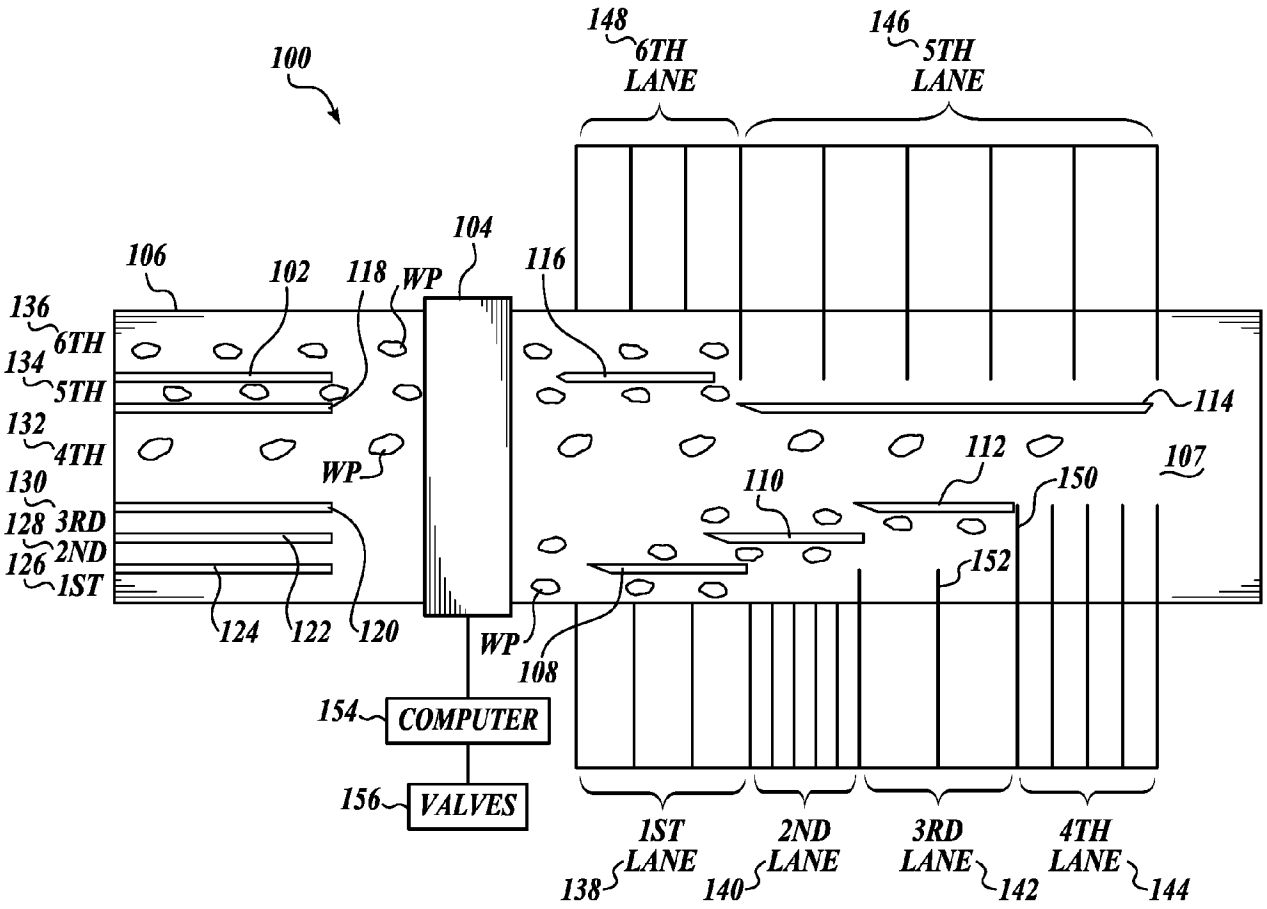
FIG. 1 is a schematic illustration of a sorting system in accordance with an embodiment.

FIG. 1 is a schematic illustration of a system 100 for sorting workpieces (herein "WP" is used to designate the workpieces generally). In some embodiments, the workpieces WP are a foodstuff. In some embodiments, the workpieces WP are raw chicken nuggets. However, the description of the workpieces WP being any particular foodstuff is not limiting.

FIG. 1 shows the sorting system 100 may be implemented on a conveyor 106. However, more than one conveyor can be used in series to achieve a similar result. The conveyor 106 can have a moving belt 107 (or belts) that slides over a support structure constructed in a standard manner. The conveyor belt 107 is driven at a selected speed by a drive motor (not shown) in a standard manner. The drive motor can be composed of a variable speed motor to adjust the speed of the belt. Generally, the workpieces WP are carried on the top surface of the conveyor belt 106 so as to pass through a scanner 104 and are then sorted. A conveyor 106 of this disclosure can have an endless belt looped over at least one drive sprocket or roller and a second follower sprocket or roller. The conveyor 106 may include a steel mesh or a steel chain link or a plastic chain link conveyor or a combination. The conveyor 106 top surface may be porous, including a porous belt 107.

In some embodiments, a portioner (not shown) is located upstream of the sorting system 100. Portioners are known that can analyze, for example, a chicken breast and portion the chicken breast into a plurality of nuggets of generally similar weight or size. In some embodiments for sorting the workpieces WP, the workpieces WP will have been cut into portions by one of a variety of portioners that are known in the art. For example, portioners for foodstuffs, such as chicken breasts, may include cutting devices, such as high pressure water jets. Other types of cutting devices may be utilized, including band saws, reciprocating saws, circular saws, guillotine, knives, and lasers. The workpieces WP can be portioned in accordance with desired parameters or characteristics of the portions, including weight, area, volume, fat content, thickness, width, length, or a combination of any parameters. After portioning, the individual pieces are separated and deposited on the conveyor 106. The conveyor 106 dimensions and speed can be matched to the capacity of the portioner.

In FIG. 1, the conveyor 106 shows a width capable of accommodating six lane divisions 126, 128, 130, 132, 134, and 136 (herein "LD" is used to designate the lane divisions generally). The six lane divisions LD are indicated by the designations first through sixth on the left side of the conveyor. Although six lane divisions LD are shown, more or fewer lane divisions LD can be used depending on the application and the number of sorts to be achieved. Accordingly, the number of lane divisions LD in FIG. 1 represents one embodiment for illustration purposes.

The workpieces WP are singulated when being deposited on the conveyor 106. "Singulated" in the case where workpieces WP are cut from larger portions can mean to separate from other workpieces WP to create separation of the workpieces WP along the length of the conveyor 106 as well as separation along the width of the conveyor 106. Thus, singulated workpieces WP are loaded on the conveyor 106 in one or more of the six lane divisions LD.

Referring to FIG. 1, the conveyor 106 may include one or more lane diverter bars 102, 118, 120, 122, and 124 (herein "DB" is used to designate the lane diverter bars generally). Lane diverter bars DB provide physical separation of the lane divisions LD. The lane diverter bars DB are positioned in the front area (forward area) of the conveyor 106. The lane diverter bars DB will assist in forming the workpieces WP in an orderly row in each lane division. Arranging the workpieces inline in a lane division will place each workpiece at substantially the same distance from the nozzles that blow the workpieces off the conveyor. Having a constant distance between workpieces and the nozzles will lead to consistency and accuracy. This way, the blow off time can be kept short and workpieces can be spaced close together down the conveyor. A lane division is an area on the conveyor 106 defined by a width across the conveyor 106 that extends along the length of the conveyor 106. In FIG. 1, five (5) lane diverter bars DB are illustrated to create six (6) lane divisions LD. However, the system 100 is adaptable to allow fewer or more lane diverter bars DB to be used to create fewer or more lane divisions LD on the conveyor 106. In some embodiments, a lane division can occupy about 2.5 inches of width of the conveyor 106 top surface. However, a conveyor 106 can have both narrow and wide lane divisions LD on the same conveyor 106 to accommodate sorting relatively small workpieces WP, such as chicken nuggets, and relatively large workpieces WP, such as chicken breasts. A feature of the sorting system 100 is flexibility to provide options for sorting a plurality of different workpieces WP into a variety of different sorts. That is, the sorting system 100 is easily configurable as to lane width, number of lane divisions LD, and number of sorts. Accordingly, neither the width nor the number of lane divisions LD is limiting. In some embodiments, all the lane divisions LD are of similar width and in some embodiments, the lane divisions LD can be of dissimilar width, including both narrow and wide lane divisions LD.

In some embodiments, lane diverter bars DB are a rigid piece of steel or plastic or a combination of plastic and metal. In some embodiments, the lane diverter bars DB can be narrow in width and can have a large length-to-width ratio. In some embodiments, the lane diverter bars DB are straight. In some embodiments, the lane diverter bars DB are placed stationery with respect to the conveyor top surface. In some embodiments, lane diverter bars DB are supported only slightly above the conveyor surface. In some cases, the lane diverter bars DB may be allowed to touch the surface of the conveyor. The lane diverter bars DB should be arranged nearly parallel to the direction of travel of the conveyor 106, because the workpieces WP should remain in their respective lanes for sorting. That is, the workpieces WP travel down the conveyor within a defined lane width. When a plurality of lane diverter bars DB are used, the lane diverter bars DB can be parallel to each other. In some embodiments, workpieces WP stay in their respective lane division throughout the length of the conveyor 106 until sorted. In some embodiments, the conveyor 106 may use a plurality of vacuum nozzles directed below the conveyor belt to assist with maintaining the individual workpieces WP in their respective lanes. The vacuum nozzles can be coordinated to release workpieces WP at the same time that a jet of air is directed at the workpieces WP to blow the workpieces WP off the conveyor 106 top surface. While air is disclosed as being a fluid suited to the sorting of the workpieces WP, it is appreciated that other fluids, including gases, such as nitrogen may be used.

Referring to FIG. 1, in some embodiments, the sorting system 100 includes a scanner 104. A scanner 104 is used for identifying a characteristic to be used as the sorting characteristic. The sorting characteristic can include weight, color, length, width, height, volume, size, shape, area, contour, fat percent, density, mass, type, defect, and foreign object, or any other characteristic or a combination that can be used to differentiate the workpieces WP from each other. Workpieces WP can be sorted according to weight into different sorting chutes, for example. However, the sorting system 100 can sort according to more than one parameter at a time. In some embodiments, the scanner 104 will determine more than one characteristic, such as the type of workpiece and the weight. Then, the sorting system 100 can sort the workpieces so the same type of workpiece are collected together at the same time that they are sorted according to weight, into a single sorting chute or several sorting chutes. For example, the sorting system 100 can achieve packages of specific ratio of mixed workpieces meeting an overall total weight. For example, the sorting system 100 can achieve packages of mixed vegetables or nuts with a specific ratio of each different vegetable or nut, while at the same time keeping track of the weight. Scanners that can determine workpiece characteristics, such as weight, type, size, and the like, at a fast rate are known.

The workpieces WP are carried by the conveyor 106 to a scanning or vision station 104 while in the respective lane division in which the workpieces WP were first loaded. The scanner 104 scans the workpieces WP, and then ascertains one of a number of physical characteristics, for example, size and shape. Then, the scanner 104 can determine the weight of each workpiece, typically by utilizing an assumed density for the workpieces WP. In some embodiments, all lane divisions LD can be loaded with workpieces WP. However, in some embodiments, less than all lane divisions LD can be loaded with workpieces WP. Further, the workpieces WP from lane to lane can vary in size. For example, in some embodiments, one lane division can carry chicken nuggets, while another lane division can carry whole chicken parts, such as breasts or thighs. Then, the chicken nuggets are further sorted down the conveyor 106 according to a classification parameter, and the breasts or thighs are also further sorted down the conveyor 106 according to a classification parameter.

The scanning to determine the physical characteristics can be carried out utilizing a variety of techniques, including a video camera to view a workpiece illuminated by one or more light sources. Light from the light source is extended across the moving conveyor 106 belt to define a sharp shadow or light stripe line with the area forwardly of the transverse beam being dark. When no workpiece is being carried by the conveyor 106, the shadow line/light stripe forms a straight line across the conveyor belt 107. However, when a workpiece passes across the shadow line/light stripe, the upper, irregular surface of the workpiece produces an irregular shadow line/light stripe as viewed by a video camera directed downwardly on the workpiece and the shadow line/light stripe. The video camera detects the displacement of the shadow line/light stripe from the position it would occupy if no workpiece were present on the conveyor 106 belt. This displacement represents the thickness of the workpiece along the shadow line/light stripe. The length of the workpiece is determined by the length of time that shadow lines are created by the workpiece. In this regard, an encoder is integrated into the conveyor 106, with the encoder generating pulses at fixed time intervals corresponding to the forward movement of the conveyor 106.

In lieu of a video camera, the scanning/vision station 104 may instead utilize an x-ray apparatus for determining the physical characteristics of the workpiece, including its shape, mass, or weight. X-rays may be passed through the object in the direction of an x-ray detector. Such x-rays are attenuated by the workpiece in proportion to the mass thereof. The x-ray detector is capable of measuring the intensity of the x-rays received thereby after passing through the workpiece. This information is utilized to determine the overall shape and size of the workpiece, as well as the mass.

In order to keep track of each workpiece and the sorting characteristic assigned to it, a memory unit is utilized in conjunction with a processing unit. The sorting characteristic concerning each workpiece may be stored in the memory unit. The memory unit may be in the form of a database that is on a network so that the result of data from any number of machines may be combined. It may be desirable that the memory unit is "in the cloud" so that results of the summing of data from more than one machine may be more easily available.

The information measured by the scanner 104 is transmitted to a computer 154, which records the location of the workpiece on the conveyor 106 as well as applies an algorithm to arrive at the particular sorting characteristic, such as weight. Based on the value of the sorting characteristic of the workpiece, the computer 154 can assign the workpiece as belonging in one of several sort classifications (or sorts). For example, if weight is the sorting characteristic, then, each sort includes a particular weight range. For example, if workpieces WP are sorted into less than 10 grams, greater than 10 grams to 15 grams, and greater than 15 grams, then, there are 3 sorts for the specific lane division. It is to be appreciated that each lane division can have a plurality of possible sorts, where not all sorts are the same between lane divisions LD. For example, one or more lane divisions LD can be used for sorting chicken nuggets simultaneously while one or more lane divisions LD can be sorting larger pieces, such as breasts and thighs. A feature of the sorting system 100 is the ability to configure each lane division to sort into different weight ranges for one application, and then, reconfigure the same lane division to sort into yet different weight ranges for a second application. For example, one lane division can be used to sort chicken nuggets in one production run into certain weight ranges, and then, the same lane division can be used to sort thighs in a subsequent production run using different weight ranges. The ability to configure sorting for each lane division can be automated. In some embodiments, the computer 154 includes a user interface. The user interface is used by an operator of the system to be able to configure each lane division for the number of sorts and the range of each sort. For example, the user can input the number of sorts and the weight ranges for each sort pertaining to each of the first through sixth lane divisions LD shown in FIG. 1.

Referring to FIG. 1, the sorting system 100 includes blow off bars to blow off the workpieces WP from the conveyor 106 top surface into sorting chutes. FIG. 1 shows five blow off bars 108, 110, 112, 114, and 116 (herein "BB" is used to designate the blow off bars generally). However, the number of blow off bars BB is not limited.

The blow off bars BB can be narrow in width, and have a high length-to-width ratio. The length is generally set by the number of nozzles contained in the blow off bar. In some embodiments, the blow off bars BB are straight. In some embodiments, the blow off bars BB are stationary with respect to the conveyor 106 surface. In some embodiments, blow off bars BB are supported only slightly above the conveyor 106 surface. In some cases, the blow off bars BB may be allowed to touch the surface of the conveyor 106 when the blow off bars BB do not impede the conveyor 106.

In FIG. 1, each of the blow off bars BB is in line with one of the lane diverter bars DB. In addition to being aligned with a respective lane diverter bar, blow off bars BB extend for a portion of the length of the belt conveyor 106. FIG. 1 shows the workpieces WP travel in line in the respective lane division from the lane diverter bars DB, through the scanner 104, and then, pass the side of the corresponding blow off bar.

The blow off bars BB include one or more nozzles that are connected to a pressurized gas supply, such as air. The blow off bars BB include one or more than one nozzle to deliver pressurized gas in a direction generally transverse (across) with respect to the direction of travel of the belt conveyor 106. The nozzles blow off workpieces WP to the lateral sides of the conveyor 106. Each nozzle may have a fast-acting valve that is actuated to allow a precisely timed jet of air across the conveyor 106 surface for a pre-determined time period. In some embodiments, the blow off bars BB include a plurality of valved nozzles, wherein the nozzles are located on the side of the blow off bar and the nozzles are aimed slightly above the surface of the conveyor belt 107. The nozzles can be aimed higher or lower depending on the workpieces WP that are to be sorted. Generally, the blow off bars BB will discharge gas transverse to the belt conveyor 106 to blow workpieces WP off the conveyor belt 107 lateral edges and into one of a plurality of sorting chutes. For example, blow off bar 108 may include three nozzles to correspond with three sorting chutes labeled first lane, 138. Blow off bar 110 may include five nozzles to correspond with five sorting chutes labeled second lane, 140. Blow off bar 112 may include two nozzles to correspond with two sorting chutes labeled third lane, 142. Blow off bar 116 may include three nozzles to correspond with three sorting chutes labeled sixth lane, 148. In some embodiments, a grouping of nozzles corresponds with a sorting chute. Blow off bar 114 includes nozzles on the right and left side of the blow off bar 114. Blow off bar 114 may include four nozzles on one side to correspond with four sorting chutes labeled fourth lane 144. Blow off bar 114 may include five nozzles on an opposite side to correspond with five sorting chutes labeled fifth lane, 146. It should be noticed that the workpieces WP in each lane division LD marked on the left side of FIG. 1 are sorted only into a subset of the entire sorting chutes that correspond with the lane division. So, workpieces WP loaded in the first lane division 126 are sorted into the three sorting chutes marked "first lane" 138 on the side of the conveyor 106. The same applies to the second through sixth lane divisions LD. It can be seen that the length of a blow off bar generally corresponds with the distance covered by the sorting chutes arranged along the conveyor 106 side.

In some embodiments, sorting chutes are U-shaped elongated channels that have an opening along the lateral side of the conveyor 106 top surface, so as to be able to catch workpieces WP that are blown into the opening. Sorting chutes may be sloped downward from the conveyor 106 top surface to allow the workpieces WP to travel by sliding into a collecting bin. In some embodiments, the workpieces WP can be moved to another area for further processing.

Referring to FIG. 1, in some embodiments, a sorting chute includes a chute diverter, such as elements 150, 152. A chute diverter includes an upright plate, wherein the upright plate is placed on edge transversely across the conveyor 106. Chute diverters 150, 152 can be aligned with a lateral edge of the chute entrance. In some embodiments, the purpose of the chute diverters 150, 152 is to catch workpieces WP that are not blown off the conveyor 106 and to prevent the workpieces WP from traveling downstream where they may be blown into other chutes that are not designated for the sort classification assigned to the workpieces WP. In some embodiments, the chute diverter 150 can extend near to the side of the blow off bar 112. In some embodiments, the chute diverter 152 can extend to a distance approximately half way to the blow off bar 112.

In some embodiments, a blow off bar can have the same number of nozzles as the number of sorting chutes, so that one nozzle corresponds to one sorting chute. A single nozzle may suffice to blow off small workpieces WP, such as chicken nuggets. However, in some embodiments, more than one nozzle can correspond with a single sorting chute. In some embodiments, more than one nozzle is used simultaneously to blow off a workpiece into a single sorting chute. Multiple jets from more than one nozzle may be needed in the case where workpieces WP are of a large size and require the use of multiple jets hitting the workpiece at more than one location. Multiple jets hitting a large workpiece simultaneously can push the workpiece to the side compared to a single jet that may simply spin the workpiece in place with little side movement. In some embodiments, multiple jets from more than one nozzle in a grouping of nozzles may be turned on with only a slight time delay between nozzles in the grouping. In some embodiments, workpieces may be blown off easier by having two or more differently timed jets. For example, one nozzle is aimed for "lifting" a workpiece, and one nozzle is aimed to direct the workpiece across the conveyor belt. The nozzle aimed for lifting is turned on first, before the second nozzle for blowing across is turned on. In some cases, some nozzles may turn on and off, before turning on another nozzle aimed at the same or different location.

Each valve of each nozzle is controlled by an algorithm running on the computer 154. As disclosed above, a computer 154 is capable of knowing the position of each workpiece down the conveyor 106. The computer 154 can calculate when the target workpiece is passing by the sorting chute that is designated for the particular characteristic of the target workpiece. For example, it is relatively simple to know the time for a workpiece to reach the assigned sorting chute when the conveyor 106 speed is known. When a workpiece having a specified characteristic passes by a sorting chute that is designated for the specified characteristic, the computer 154 commands the valve of the nozzle located across from the sorting chute to open and close, thereby quickly releasing a pulse of air that blows the workpiece into the proper sorting chute. Also, as mentioned before, multiple nozzles can be used, so the computer 154 can activate multiple valves for blowing off large workpieces WP.

Referring to FIG. 1, in some embodiments of the sorting system 100, the blow off bars BB are staggered along the length of the conveyor belt 107 so that the jets of air are not blocked by other blow off bars BB. For example, blow off bars 108, 110, and 112 are staggered and do not overlap or overlap only at the ends so as to not interfere with each other. Further, blow off bars 108, 110, and 112 are progressively placed toward the center of the conveyor belt 107 while also being aligned with the respective lane diverter bar. For example, blow off bar 108 is aligned with lane diverter bar 124. Blow off bar 110 is aligned with lane diverter bar 122. Blow off bar 112 is aligned with lane diverter bar 120. Blow off bar 114 is aligned with lane diverter bar 118. Blow off bar 116 is aligned with lane diverter bar 102. Blow off bar 114 is an example where one blow off bar substantially overlaps (more than half of its length) with other blow off bars, namely 110 and 112. However, blow off bar 114 does not have nozzles to direct air jets in the area blocked by blow off bars 110 and 112. Blow off bar 114 does have nozzles to direct air jets toward the fourth and fifth lane sorting chutes 144, 146 on respective left and right sides of the conveyor belt 107.

A feature of the sorting system 100 is to be configurable to include the use of all lane divisions LD and blow off bars BB or only a single lane division and blow off bar or any number in between depending on the particular sorting requirements. For example, the sorting system 100 can operate by loading all six lane divisions LD with workpieces WP and sorting all workpieces WP in the six lane divisions LD simultaneously, and then, blowing the workpieces WP of each lane division into still further narrow sorts. Initially the workpieces WP can be sorted into six broad coarse categories represented by the six lane divisions LD. Then, all of the workpieces WP in each lane division are further sorted into a narrower subset of the coarse or broad category. However, there is no requirement to use all six lane divisions LD at once. There is no requirement in the number of lane divisions LD. Further, there is no requirement that all lane divisions LD need to sort differently. Further, there is no requirement that the coarse or broad category be the same characteristic as the narrow or fine sorting characteristic. For example, in an embodiment, the lane divisions LD can be loaded according to leg, breast, wing, thigh, or white/dark meat. Then, the narrow or finer sorting uses the blow off bars BB to sort workpieces WP according to weight.

Also, the scanner 104 retains and keeps track of the location of each workpiece on the conveyor 106 surface and the speed of the conveyor, so that the location of each workpiece on the conveyor belt 107 surface is precisely known as the workpieces WP travel down the conveyor 106. With this information, the sorting system 100 will be able to time a properly directed jet or jets of air to blow off the workpiece from the conveyor belt 107 surface into the proper collecting chute.

Figure 2:
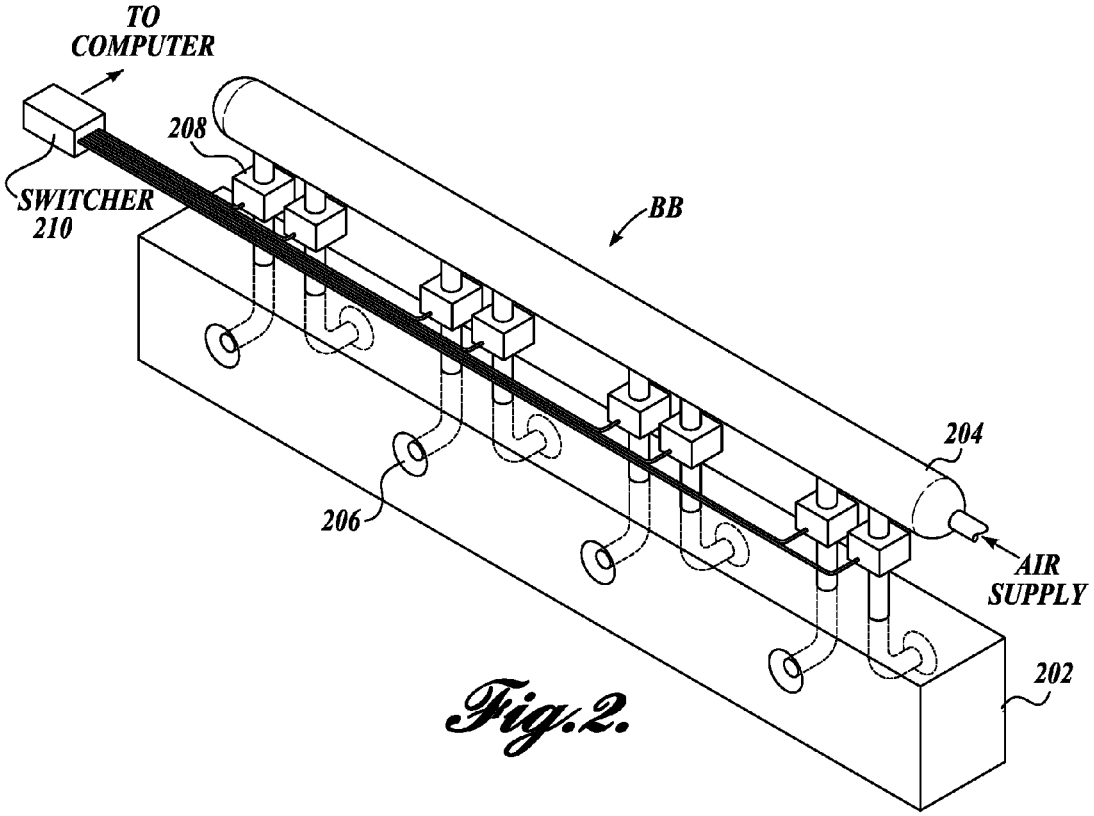
FIG. 2 is a diagrammatical illustration of a blow off bar in accordance with an embodiment.

Referring to FIG. 2, an embodiment of a blow off bar 202 is diagrammatically illustrated. In some embodiments, the blow off bar 202 is elongated, straight, and has a quadrilateral cross-sectional shape. However, blow off bars BB are not limited to quadrilateral cross-sectional shapes, and can have cross-sectional shapes including round, oblong, or a combination of curves and straight sections. The blow off bar 202 includes nozzles 206 along the length of the blow off bar on a first lateral side and a second lateral side. However, other blow off bars BB can be constructed that only have nozzles 206 on a single lateral side. In some embodiments, the nozzles 206 may use a ball and socket type nozzle to be able to adjust the jet of air in the up and down direction, as well as the side-to-side direction. The nozzles 206 include an aperture which leads to a passageway through the blow off bar 202. The passageways from the blow off bars BB are individually connected to piping or tubing having a valve 208. The valves 208 connect to an air manifold header 204 which is supplied by any air supply source. The air manifold header 204 acts as a reservoir to avoid sudden drops in air supply source pressure when one or more valves are opened. Accordingly, pressurized air can be expelled through the nozzles by operation of the valves 208. The valves 208 are connected to a switching device 210 which is connected to the computer 154. Upon instructions from the computer 154 regulating when to open and blow off time, the switching device 210 sends a signal to open the valves 208. The valves 208 may include an electrically activated solenoid. The computer 154 is programmed to time the opening of each valve 208 by sending a signal to the individual solenoids to open one or more of the valves 208 for a pre-determined time and then close to cause the workpiece to be blown into the desired sorting chute.

Figure 3:
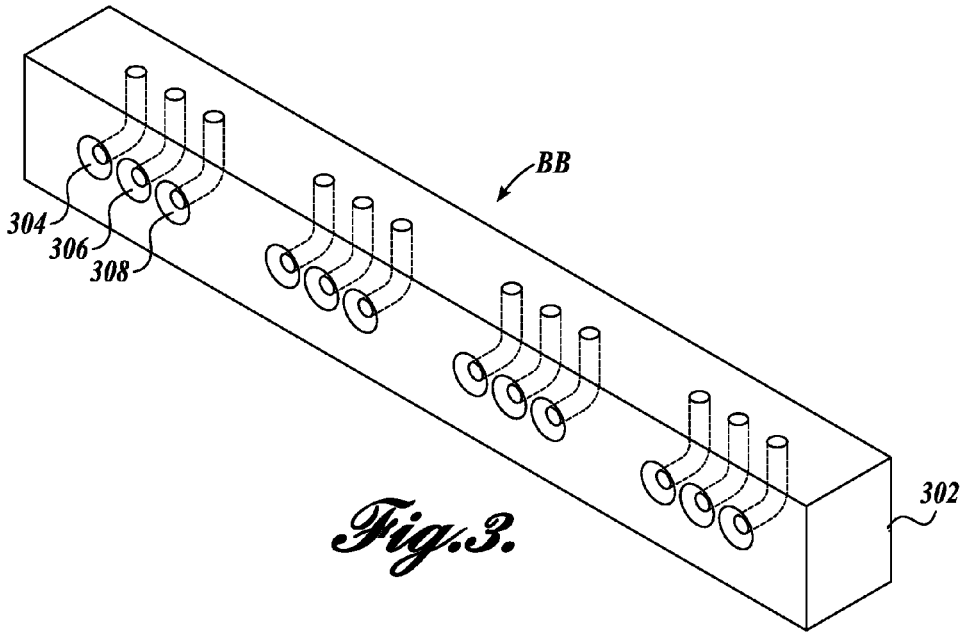
FIG. 3 is a diagrammatical illustration of a blow off bar in accordance with an embodiment.

Referring to FIG. 3, an embodiment of a blow off bar 302 is diagrammatically illustrated. The blow off bar 302 includes a set of nozzles 304, 306, and 308 grouped closely together. The grouping of more than one nozzle can be used to blow off large workpieces WP. The blow off bar 302 includes more than one grouping of nozzles. Similar to the blow off bar 202 of FIG. 2, the blow off bar 302 of FIG. 3 will have valves for each individual nozzle, wherein the valves are controlled to open according to a timing calculation of when a workpiece meeting the desired sort classification passes by the particular valve or group of valves. While each nozzle 304, 306, and 308 may include a valve, in some embodiments, each grouping of valves may only include a single valve. For example, nozzles 304, 306, and 308 may be joined through piping so that all three nozzles are supplied with pressurized air by opening a single valve. As with FIG. 2, the valves will be commanded to open and close based on electronic signals sent by the computer 154.

Figure 4:
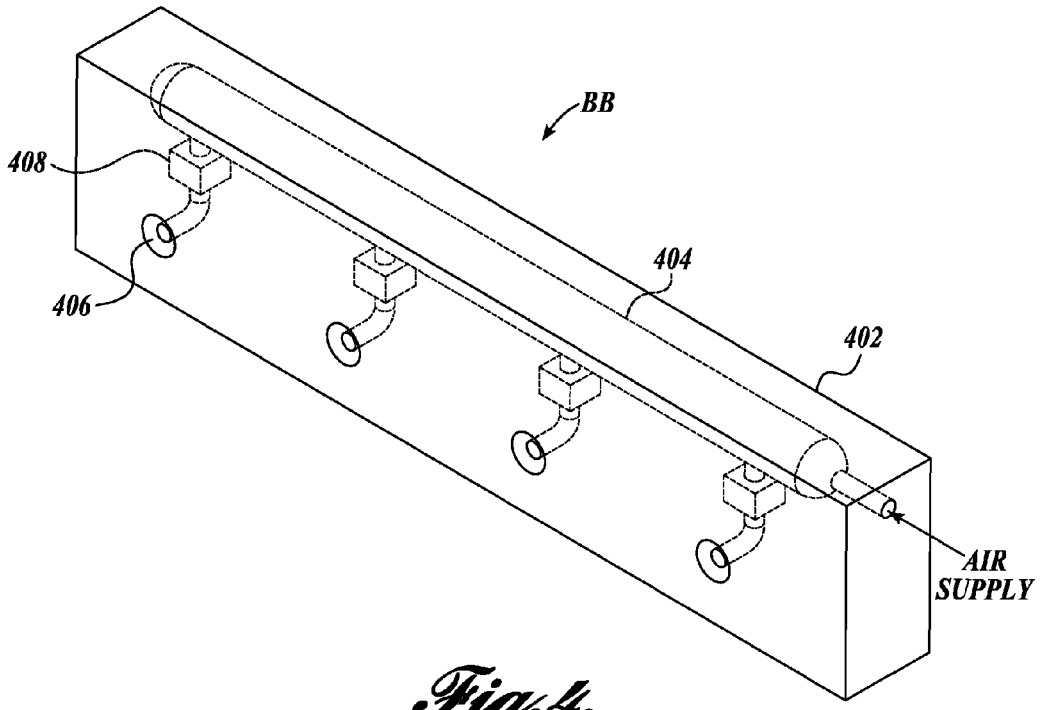
FIG. 4 is a diagrammatical illustration of a blow off bar in accordance with an embodiment.

Referring to FIG. 4 an embodiment of a blow off bar 402 is diagrammatically illustrated. In some embodiments, the blow off bar 402 is elongated, straight, and has a quadrilateral cross-sectional shape. The blow off bar 402 includes nozzles 406 along the length of the blow off bar 402 on a first lateral side. In some embodiments, nozzles 406 can be provided on a second opposite lateral side. In some embodiments, the nozzles 406 may use a ball and socket type nozzle to be able to adjust the jet of air in the up and down direction, as well as the side-to-side direction. The nozzles 406 include an aperture which leads to a passageway through the blow off bar 402. The passageways from the individual nozzles 406 are individually connected to piping or tubing having a valve 408. The valves 408 connect to an air manifold header 404, which is supplied by any air supply source. The air manifold header 404 acts as a reservoir to avoid sudden drops in air supply source pressure when one or more valves are opened. Accordingly, pressurized air can be expelled through the nozzles by operation of the valves 408. A difference between the embodiment of FIG. 4 and that of FIG. 2 is the incorporation of the air manifold header 404 and valves 408 within the blow off bar 402. The valves 408 are further connected to a switching device which is connected to the computer 154. Upon instructions from the computer 154 regulating when to open and the blow off time, the switching device sends a signal to open the valves 408. The valves 408 may include an electrically activated solenoid. The computer 154 is programmed to time the opening of each valve 408 by sending a signal to the individual solenoids to open one or more of the valves 408 for a pre-determined time and then close to cause the workpiece to be blown into the desired sorting chute.

Figure 5:
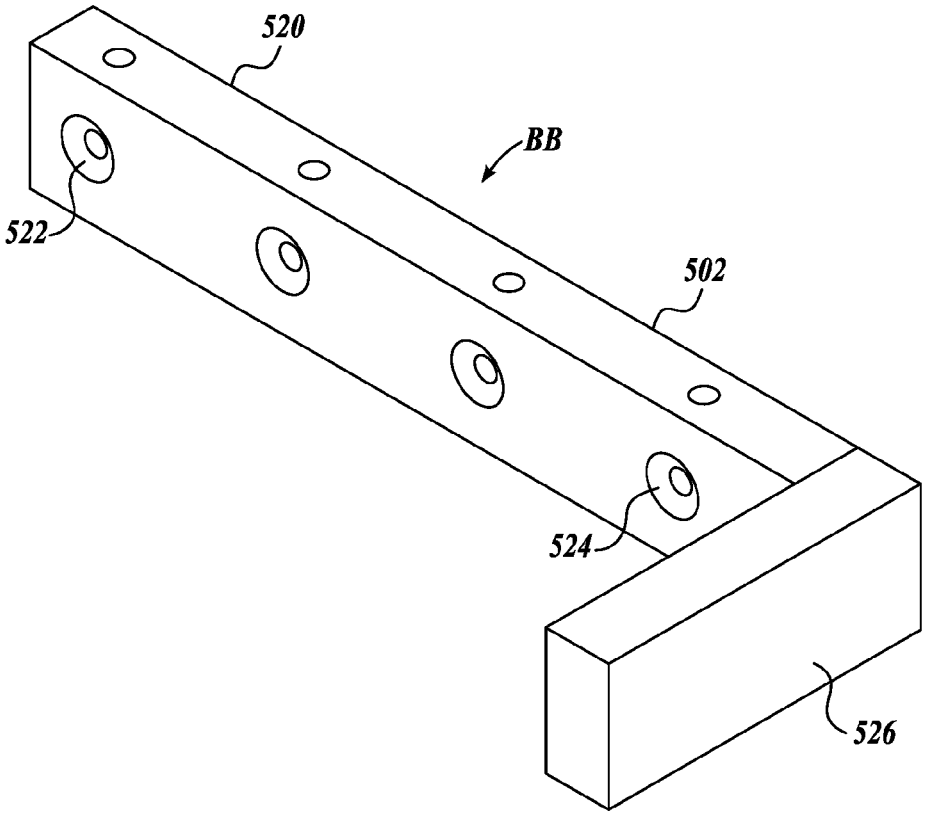
FIG. 5 is a diagrammatical illustration of a blow off bar in accordance with an embodiment.

Referring to FIG. 5, an embodiment of a blow off bar 502 is schematically illustrated. In some embodiments, blow off bars BB can be bent or have sections that extend across the conveyor as well as sections that extend down the conveyor. For example, in FIG. 5, the blow off bar 502 has a first elongated, straight section 520. The blow off bar 502 of FIG. 5 includes a second section 526 that extends cross-wise from the first section 520. The second section 526 is placed at or bent from the end of the first section 520. Thus, not all blow off bars BB are straight. FIG. 5 shows that some blow off bars can have bends or include sections that are placed at an angle. In FIG. 5, the second section 526 is at an angle to the first section 520. The second section 526 may or may not have air nozzles. In some embodiments, the second section 526 may also have air nozzles. In some embodiments, the second section 526 that is at an angle functions as a "chute diverter." A chute diverter can basically catch any workpiece that is not blown off the conveyor. In some embodiments, the length to width ratio of the first section 520 is greater than the length to width ratio of the second section 526 to resemble an "L" shape. In some embodiments, the length of the second section 526 across the conveyor corresponds to the width of the lane division. An air nozzle 524 may be placed near to the bend at the second section 526 to blow off workpieces WP that are caught by the chute diverter section 526. Therefore, chute diverters can be placed on the ends of the blow off bars BB, or chute diverters can be placed on the sorting chutes. The first section 520 of the blow off bar 502 can include air nozzles 522 along the length of the blow off bar 502 on a first lateral side and a second lateral side as described above in relation to FIGS. 2-4.

Figure 6:
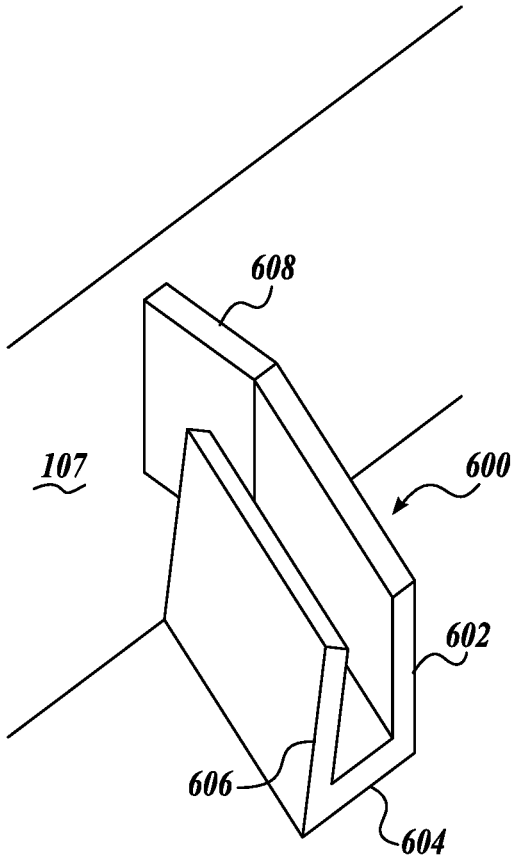
FIG. 6 is a diagrammatical illustration of a sorting chute and chute diverter in accordance with an embodiment.

Referring to FIG. 6, an embodiment of a sorting chute 600 with a chute diverter 608 is diagrammatically illustrated. The sorting chutes, like sorting chute 600, are used to collect workpieces WP that are blown off the conveyor surface 107 in FIG. 1. Sorting chutes, like sorting chute 600, are placed along the length of the conveyor surface 107 so that a subset of sorting chutes is assigned to each lane division. In FIG. 1, for example, each subset of sorting chutes is labeled with the lane division that is assigned to the subset. In FIG. 1, there are first through sixth lane divisions LD corresponding to first through sixth subsets of sorting chutes. Referring back to FIG. 6, in some embodiments, a sorting chute 600 can resemble a U-shaped channel with an opening at both ends. In the embodiment of FIG. 6, the sorting chute 600 has a right side (downstream) upright panel 602, a left side (upstream) upright panel 606, and a flat bottom side panel 504 connecting the left and right panels. However, other sorting chutes can have other shapes, such as a cylinder or half cylinder, or a single flat panel, and the like. A plurality of sorting chutes 600 can be placed side to side along the lateral edge of the conveyor 106 so that the chutes' side panels abut against each other, or in some embodiments, individual sorting chutes 600 may have a space between each sorting chute. The sorting chute 600 can be made from metal or plastics or both. The sorting chute 600 directs the workpiece that is blown off the conveyor 106 into the appropriate receptacle for the sorting classification.

Referring to FIG. 6, an optional feature of sorting chutes 600 is the provision for a chute diverter 608. In some embodiments, the chute diverter 608 is an upright flat panel placed on edge across the top surface of the conveyor 106. In some embodiments, the chute diverter 608 catches workpieces WP that may not have been blown off the conveyor 106. In some embodiments, the chute diverter 608 can be angled upstream into the direction of the advancing conveyor 106. An angle to the chute diverter 608 can provide a sideways force component that can nudge the workpiece to the chute opening. In some embodiments, the chute diverter 608 is attached to the end of the right side panel 602 of the sorting chute 600, as illustrated. That is, the chute diverter 608 is placed on the down side of the chute 600 opening. However, chute diverters 608 can be placed on both sides of the sorting chute 600, particularly where the sorting chutes 600 are touching side by side. However, chute diverters 608 are optional, and can be placed on one or both or neither side of a sorting chute 600. In some embodiments, the chute diverter 508 length can extend across the conveyor 106 to the blow off bar or near to the blow off bar. In some embodiments, the chute diverter 608 length can extend across the conveyor 106 to about half way to the blow off bar. In some embodiments, the chute diverter 608 length can correspond to the width of the lane division. In some embodiments, a chute diverter 608 is placed on the last one of the sorting chutes 600 assigned for one lane division. That is, if the workpieces WP fail to be blown off the first ones of the sorting chutes 600, the chute diverter 608 on the last sorting chute 600 will catch the workpiece and prevent it from traveling further. Those workpieces WP that are collected by chute diverters 608 can be knocked off the conveyor 106 by other workpieces WP, or a nozzle can be fired to clear the chute diverter 608 of collected workpieces WP. In some embodiments, the sorting chutes 600 in a lane division may be arranged along the lateral side of the conveyor 106 in order of decreasing weight sorts, so that if a workpiece is not blown off the first ones of the sorting chutes 600, the workpiece will be collected in the last sorting chute 600 which collects workpieces WP of the lowest weight, and thus, any workpieces WP that are collected by the chute diverter 608 of the last sorting chute 600 would be at least at the desired lowest weight sort or greater to avoid "shorting" on weight.

Figure 7:
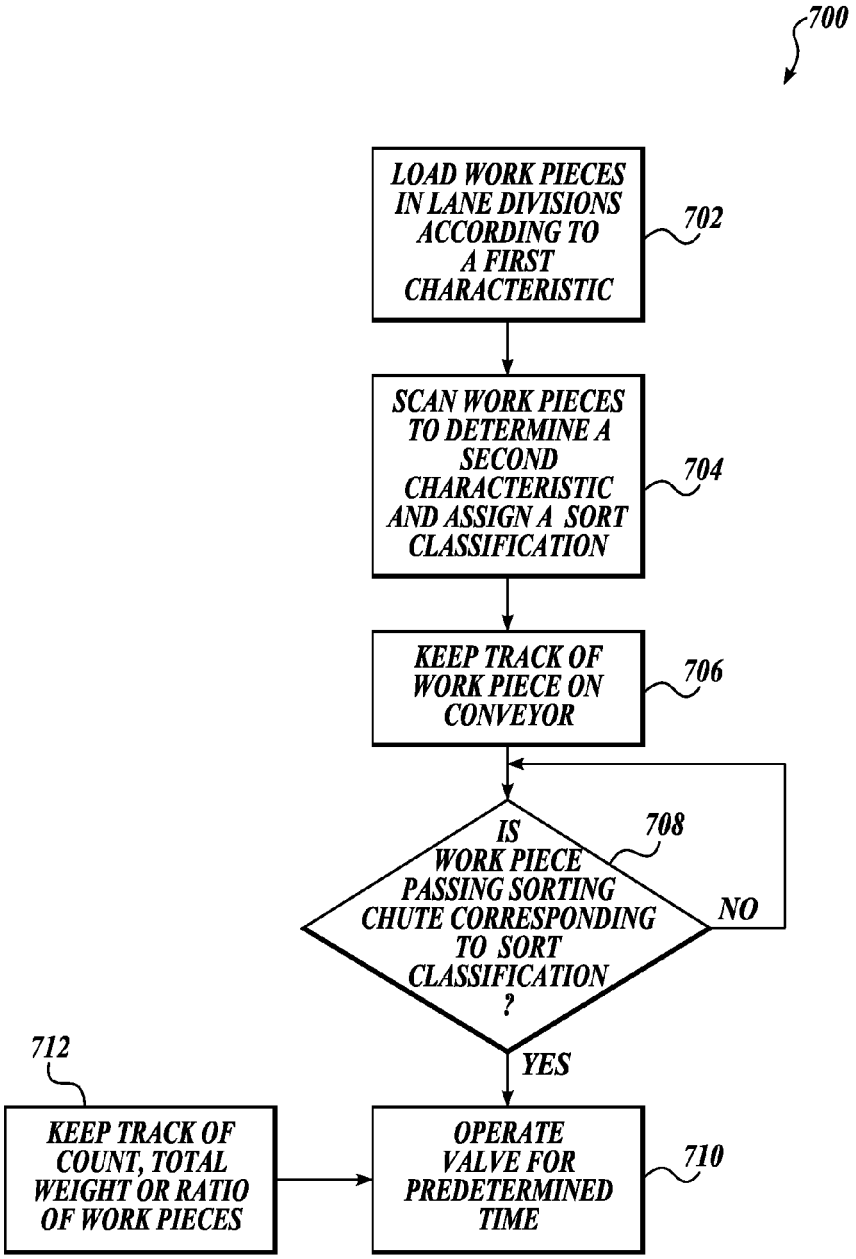
FIG. 7 is a flow diagram of a method in accordance with an embodiment.

Referring to FIG. 7, a flow diagram of an embodiment of a method for sorting workpieces WP continuously on a conveyor 106 is illustrated. In step 702, the method includes a step for loading workpieces WP in lane divisions LD according to a first characteristic. In some embodiments, step 702 may be optional because all lane divisions LD being used may be sorting into the same sort classifications, or because only a single lane division is being used for sorting. From step 702, the method enters step 704. In step 704, the method scans the workpieces WP and determines a second characteristic, and assigns a sort classification to the workpieces WP. From step 704, the method enters step 706. In step 706, the method keeps track of the workpieces WP as the conveyor 106 advances. From step 706, the method enters step 708. In step 708, the method tests whether a workpiece with an assigned classification sort is passing by the sorting chute corresponding to the second sort classification. In some embodiments, a computer 154 is used to determine precisely when the workpiece with the assigned sort classification is passing by the sorting chute. The computer 154 may, for example, keep track of the time from when the workpiece passes in the scanner 104. From step 708, the method enters step 710 when the method, via the computer 154, has determined that the workpiece with the assigned sort classification is passing by the corresponding sorting chute. Then, the computer 154 sends a signal to open the appropriate valve for the desired time to produce a jet of air from a nozzle across from the sorting chute and blows the workpiece into the sorting chute.

While FIG. 7 shows a simplified sort based on a single characteristic, the computer 154 can be programmed to carry out more complex sorting schemes. One example would be sorting chicken nuggets into packages based on overall weight and nugget count, for example. The sorting system can achieve sorting according to a certain count, such as, for example, packages of either 8 or 12 chicken nuggets, and where each of the nuggets has to fall within a certain size or weight range, and overall, the package needs to meet a total weight. This disclosure provides a sorting system to prepare a package sorted simultaneously by count, overall weight, and individual nugget weight or size, for example. This way, the nuggets or other workpieces WP can be sorted into packages of the correct count meeting weight requirements for individual nuggets as well as overall weight. Then, restaurants or consumers can be assured that the package contains the correct count, the correct overall weight, and the correct weight or size for each individual nugget. The more sorts that are available in assembling these small 8 or 12 count batches, the more accurate can be the fill.

Referring to FIG. 7, in step 710, the computer 154 can implement an algorithm, step 712, that keeps track of the count of workpieces WP going to each sorting chute, the overall weight of workpieces WP going to each sorting chute, and through the algorithm, the computer 154 can select the correct workpieces WP to result in the correct overall weight while keeping count. For example, in step 712, the count can be determined by the number of times a particular valve is opened. In step 712, the overall weight is simply addition of the weight of each workpiece that is blown into a specific sorting chute to keep a running weight total collected in the sorting chute. In step 712, when the correct count and running weight total is reached, a robot may replace the completed package with a new empty package under the chute, and the counter and weight tally are reset to zero and restart the count and weight tally for the new package. The sorting system has advantages because the number of sorts can be maximized, the distance between the workpieces WP from the blow off nozzle can be minimized, and the distance the workpieces WP must be blown to enter the chutes is also minimized. Therefore, the chutes and "bins" (or maybe plastic bags), can be very small, and the number of sorts (which are also choices for filling the batch), high.

A modification of step 712 is to keep track of the ratio of different workpieces going into each sort. The sorting system 100 can sort different products into a single package keeping track of each different workpiece and the overall weight for the package. For example, the sorting system 100 can achieve packages containing mixed vegetables, mixed nuts, or other mixed workpieces WP according to a ratio and overall weight total. For example, the weight and type of each workpiece that passes under the scanner 104 can be determined by the scanner 104. With this information, the computer 154 can control the blow off nozzles to blow off and keep count of the number of a certain vegetable or nut that is collected in a sorting chute to achieve a certain ratio and together with keeping a running weight total or count for each sorting chute.

Based on the FIGURES and the disclosure, a sorting system 100 is disclosed comprising a conveyor system 106 including a conveyor 106 top surface 107 that advances in a forward direction; one or more lane diverter bars DB positioned over the top surface of the conveyor system 106, wherein the lane diverter bars DB extend lengthwise along the conveyor system 106 forward advancing direction, and the lateral regions to the left and right of the lane diverter bars DB define lane divisions LD; one or more blow off bars BB are positioned over the top surface of the conveyor system 106, wherein the blow off bars BB extend lengthwise along the conveyor system 106 forward advancing direction, wherein the blow off bars BB include one or more valved nozzles 206 connected to a pressurized fluid source, and the nozzles are positioned to discharge the fluid across the conveyor to blow off workpieces WP that have been assigned a sort category based on a characteristic. In some embodiments, each of the blow off bars BB is aligned with one of the lane diverter bars DB.

In some embodiments, a sorting system 100 further includes a scanner 104 placed over the conveyor system 106 and before the one or more blow off bars BB, wherein the scanner 104 includes a light source, a collector, and a processor programmed with instructions to determine a characteristic of workpieces WP and assign each workpiece to one of a plurality of sorting categories.

In some embodiments, the lane diverter bars DB and the blow off bars BB are elongated bars that extend lengthwise along a top surface 107 of the conveyor system 106. In some embodiments, the nozzles 206 are aimed upstream or downstream with respect to the forward advancing direction of the conveyor top surface 107, and the nozzles 206 are aimed upwards or downwards with respect to a plane parallel to the top surface 107 of the conveyor 106.

In some embodiments, the sorting system 100 further includes a plurality of chutes 500 placed in sequentially along a lateral edge of the top surface 107 of the conveyor system 106, wherein each chute 600 has a chute entrance that extends lengthwise down the forward advancing direction and the chute entrance is across from a valved nozzle 206.

In some embodiments, the sorting system 100 further includes a chute diverter 600 including an upright plate 608, wherein the upright plate 608 is placed on edge transversely across with respect to the conveyor system 106 forward advancing direction, and the chute diverter 608 is aligned with a lateral edge of the chute 600. In some embodiments, the upright plate 608 is placed at an angle to point partially in a direction up the conveyor and opposite to the forward advancing direction. In some embodiments, the length of the upright plate 608 transverse to the conveyor system 106 is short of the blow off bar. In some embodiments, as shown in FIG. 1, the length of a first upright plate 152 transverse to the forward advancing direction is shorter than the length of an adjacent and subsequent down conveyor upright plate 150 that extends near to a blow off bar. In some embodiment, the upright plate 152 is placed at an angle with respect to the conveyor system 106.

In some embodiments, the sorting system 100 includes lane diverter bars DB and blow off bars BB placed after the lane diverter bars DB, wherein each of the blow off bars BB is aligned with one of the lane diverter bars DB.

In some embodiments, the blow off bars BB have valved nozzles 206 on the left and right lateral sides of the blow off bar. In some embodiments, one or more blow off bars BB have a plurality of valved nozzles 206 arranged down the conveyor and along the length of the respective blow off bar. In some embodiments, at least one blow off bar has a grouping of more than one nozzle 304, 306, 308 aimed across from a single chute.

In some embodiments, the lane diverter bars DB and the blow off bars BB are straight and have a quadrilateral cross-sectional shape for a majority of the length of the lane diverter bars DB and the blow off bars BB.

In some embodiments, a method for sorting workpieces WP is disclosed. The method includes arranging singulated workpieces WP on the top surface 107 of a conveyor system 106 in one of a plurality of lane divisions LD across the width of the top conveyor surface 107 while the top conveyor surface 107 advances in a forward direction. The method includes determining a characteristic of the workpieces WP in the lane divisions LD as the top conveyor surface 107 advances in the forward direction and assigning one of a plurality of sort categories to the workpieces WP in the lane divisions LD. In some embodiments, a scanner 104 is used to scan and a processor 154 will determine the characteristic of each of the singulated workpieces WP. The method includes blowing off the workpieces WP from the top surface 107 of the conveyor 106 with a jet of fluid, such as air, across the top surface 107 of the conveyor 106 as the workpieces WP travel down the conveyor 106, and the conveyor 106 advances in the forward direction, wherein the workpieces WP are blown off corresponding to the assigned sort category for each of the workpieces WP, and wherein the workpieces WP assigned to the same sort category are collected together.

In some embodiments, the workpieces WP are first grouped in a broad sort category when arranged in a lane division. For example, each lane division can be initially sorted according to a coarse range. Then, the workpieces WP are further assigned to a narrower sort category that is a subset of the broad sort category. The method is used to collect the workpieces WP that are assigned to the same narrower sort category.

In some embodiments, the workpieces WP arranged in at least one lane division are arranged inline and are substantially a same distance from a nozzle 206 which blows the workpieces WP off the conveyor surface 107.

In some embodiments, the workpieces WP are raw chicken nuggets. However, the invention is not thereby limited. In other embodiments, the workpieces WP are materials that need sorting. For example, foodstuffs and inanimate materials, such as rocks, are only provided as examples. In some embodiments, the scanner 104 is able to determine a characteristic that is selected from the group consisting of weight, color, length, width, height, volume, size, shape, area, contour, fat percent, density, mass, defect, and foreign object, or a combination thereof.

In some embodiments, the method further comprises blowing off the workpieces WP into one of a plurality of chutes 600 placed along the lateral edge of the top surface of the conveyor system 106, wherein each chute 600 is assigned to a different sort category. For example, referring to FIG. 1, the first through sixth lane divisions LD have a corresponding subset of sorting chutes.

In some embodiments, the method comprises blowing the workpieces WP from a single lane division off the conveyor top surface 107 by a single one of a plurality of blow off bars BB positioned lengthwise along the conveyor top surface 107. For example, referring to FIG. 1, workpieces WP on the first, second, third, and sixth lane divisions LD are correspondingly blown off the conveyor top surface 107 by a single blow off bar. That is, workpieces WP on the first second, third and sixth lane divisions LD are blown off by the blow off bars 108, 110, 112, and 116, respectively.

In some embodiments, the method includes blowing off workpieces WP from a single blow off bar into one of a plurality of sorting chutes 600 placed on the side of the conveyor 106. Referring to FIG. 1, for example, blow off bar 108 blows workpieces WP into one of three chutes labeled for the first lane division. Similarly, blow off bar 110 blows workpieces WP into one of five chutes labeled for the second lane division; blow off bar 112 blows workpieces WP into one of two chutes labeled for the third lane division; and blow off bar 116 blows workpieces WP into one of three chutes labeled for the sixth lane division. Furthermore, neither the number of lane divisions LD, nor the number of blow off bars BB, nor the number of chutes 600 for each blow off bar is limited to the number shown in FIG. 1.

In some embodiments, the method includes blowing off workpieces WP from a single valved nozzle 206 into a same chute to collect workpieces WP having the same assigned sort category. Referring to FIG. 1, each blow off bar includes one or more valved nozzles 206 that blow a workpiece into a single chute. For example, if the blow off bar has three valved nozzles, each nozzle will only blow off workpieces WP into the same chute that corresponds and is directly across from the valved nozzle. As shown, three chutes 600 comprise the first lane subset of chutes, so blow off bar 108 may have at least three valved nozzles 206, each one being aimed directly across at the corresponding chute 600. In some embodiments, the method includes blowing off workpieces WP from a single lane division into only a subset of chutes 600 placed along the sides of the conveyor top surface 107, as is the case for the first, second, third and sixth lane divisions LD. In some embodiments, the subset of chutes 600 are placed in sequence along the sides of the conveyor top surface 107. For example, FIG. 1 shows the subset of chutes 600 for the first, second, third and sixth lane divisions LD that are arranged in sequence.

In some embodiments, the method includes blowing off workpieces WP from two lane divisions LD with a single blow off bar having valved nozzles 206 on left and right sides of the blow off bar. Referring to FIG. 1, blow off bar 114 is interposed between the fourth and fifth lane divisions LD. Thus, blow off bar 114 has valved nozzles 206 on the left and right lateral sides to blow off workpieces WP in the fourth and fifth lane divisions LD. The fourth lane subset of chutes includes four chutes 600, and the fifth lane subset of chutes includes five chutes 600. It should be noticed that the number of valve nozzles 206 and chutes 600 determines the number of sorts that are possible for each lane division. For example, the first lane division has three corresponding chutes. Therefore, workpieces WP in the first lane division can be sorted into one of three different sort categories. However, in some embodiments, the valved nozzles 206 are programmable. So, the sorting system 100 can be configured to change the sorts through software using the same sorting system 100. So, for example, a three sort lane can be configured into two sorts by merely programming two of the three valved nozzles 206 to target workpieces WP having the same characteristic or simply deactivating one of the three valved nozzles to be left with two operational valved nozzles.

In some embodiments, the sorting system 100 can count the number of workpieces WP that are collected in one or more sorts, and reset the count when the count reaches a predetermined value. In some embodiments, the sorting system 100 can keep track of the overall weight that is collected in any single sorting chute 600, and the system can reset the running weight total when the weight reaches a predetermined value. For example, counting the number of workpieces WP in a sort and the keeping a running total weight is used to prepare packages having a predetermined count and total weight. In some embodiments, the sorting system 100 keeps a running total weight collected in a sort and the sort contains workpieces WP of different types to meet a predetermined ratio of different type workpieces WP, for example, mixed nuts, mixed vegetables, and the like.

Referring to FIG. 1 and to the third lane subset of chutes, a chute diverter 150 extends from the edge of the last of the chutes to almost touch the blow off bar 112. However, the chute diverter 152 that extends from the common edge of the first and second chutes only extends to about half the distance to the blow off bar 112. Chute diverters are intended to catch workpieces WP that are not blown off the conveyor top surface 107. The chute diverter prevents those workpieces WP that are not blown entirely off to accumulate against the chute diverter and prevent the workpieces WP from travelling into the next sorting chute. Then, the workpieces WP can be manually shoved into the appropriate chute, or in some cases, the workpieces WP can be knocked into the chute by a second workpiece that bumps into it from a subsequent jet of fluid. In some embodiments, the valved nozzles 206 may be programmed to do a "clearing" jet of fluid to knock any workpieces WP that have accumulated against the chute diverter.

Returning to the chute diverter 150 that extends to near the side of the blow off bar 112, this type of chute diverter 150 can be placed at the last one of the subset of chutes to catch any workpieces WP that are not blown off the conveyor or that are mis-timed and do not get blown off. In some embodiments, for those workpieces WP that do not get blown off after being subjected to a jet of fluid, the method includes catching the workpiece in a last one of a subset of chutes arranged to collect all the workpieces WP from a lane division.

While illustrative embodiments have been illustrated and described, it will be appreciated that various changes can be made therein without departing from the spirit and scope of the invention.

The embodiments of the invention in which an exclusive property or privilege is claimed are defined as follows:

1. A sorting system, comprising:

a conveyor system that advances in a forward direction; and one or more blow off bars positioned over the conveyor system, wherein an elongated dimension of the blow off bars extends along the forward advancing direction, wherein the blow off bars include one or more valved nozzles connected to a pressurized source of a fluid, and the nozzles are positioned to discharge the fluid across the conveyor system, and wherein one or more of the elongated blow off bars are positioned between different lane divisions occupying a portion of a width of the conveyor system, and wherein the valved nozzles of the elongated blow off bars in the different lane divisions are programmed to open based on a characteristic depending on the lane division.

2. The sorting system of claim 1, comprising one or more lane diverter bars positioned over the conveyor system, wherein the lane diverter bars extend along the forward advancing direction and are located before the blow off bars.

3. The sorting system of claim 2, wherein the one or more lane diverter bars and the one or more blow off bars are elongated bars that extend lengthwise along a top surface of the conveyor system.

4. The sorting system of claim 1, wherein the nozzles are positioned to discharge the fluid transversely across the conveyor system.

5. The sorting system of claim 1, wherein the nozzles are aimed upstream or downstream with respect to the forward advancing direction.

6. The sorting system of claim 1, wherein the nozzles are aimed upwards or downwards with respect to a top surface of the conveyor system.

7. The sorting system of claim 1, further comprising a scanner placed over the conveyor system and before the one or more blow off bars, wherein the scanner is programmed with instructions to determine one or more characteristics of workpieces and assign each workpiece to one or more of a plurality of sorting categories.

8. The sorting system of claim 1, further comprising a plurality of chutes placed along the conveyor system, wherein each chute has a chute entrance that extends lengthwise along the conveyor system, and the chute entrance is across from a valved nozzle.

9. The sorting system of claim 8, further comprising a chute diverter including an upright plate, wherein the upright plate is placed on edge across the conveyor system, and the chute diverter is aligned with a lateral edge of the chute entrance.

10. The sorting system of claim 9, wherein the upright plate is placed at an angle to the conveyor system.

11. The sorting system of claim 9, wherein a length of a first upright plate that is across the conveyor system is shorter than a length of an adjacent and subsequent upright plate.

12. The sorting system of claim 2, wherein each of the blow off bars is aligned with one of the lane diverter bars.

13. The sorting system of claim 1, comprising at least one blow off bar having a plurality of valved nozzles directed from opposite sides of the blow off bar.

14. The sorting system of claim 1, wherein the blow off bars are straight and have a constant cross-sectional shape for a majority of a length.

15. The sorting system of claim 1, wherein the blow off bars have a section extending down the conveyor system and across the conveyor system.

16. The sorting system of claim 1, wherein at least one blow off bar has a plurality of valved nozzles arranged along a length of the blow off bar.

17. The sorting system of claim 1, wherein at least one blow off bar has a grouping of more than one nozzle, each nozzle aimed across from a single chute.

18. The sorting system of claim 1, comprising more than one blow off bar, wherein the blow off bars are progressively placed toward the center of the conveyor system while being staggered along the length of a conveyor belt.

19. The sorting system of claim 1, comprising more than one blow off bar and a corresponding number of lane diverter bars, wherein the lane diverter bars extend along the forward advancing direction of the conveyor system and are located before the blow off bars, wherein each of the blow off bars is aligned with one of the lane diverter bars, and the blow off bars are straight and have a plurality of nozzles.

* * * * *